US010654292B2

(12) United States Patent
Hatakeyama et al.

(10) Patent No.: US 10,654,292 B2
(45) Date of Patent: May 19, 2020

(54) LIQUID DISCHARGE APPARATUS

(71) Applicants: Taku Hatakeyama, Kanagawa (JP); Takashi Watanabe, Kanagawa (JP); Kaoru Tadokoro, Kanagawa (JP); Sho Oyamatsu, Tokyo (JP); Tomohiro Inoue, Kanagawa (JP); Hiroshi Gotou, Kanagawa (JP); Mio Kumai, Tokyo (JP)

(72) Inventors: Taku Hatakeyama, Kanagawa (JP); Takashi Watanabe, Kanagawa (JP); Kaoru Tadokoro, Kanagawa (JP); Sho Oyamatsu, Tokyo (JP); Tomohiro Inoue, Kanagawa (JP); Hiroshi Gotou, Kanagawa (JP); Mio Kumai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/351,577

(22) Filed: Mar. 13, 2019

(65) Prior Publication Data

US 2019/0283460 A1 Sep. 19, 2019

(30) Foreign Application Priority Data

Mar. 16, 2018 (JP) ..... 2018-050261
Oct. 22, 2018 (JP) ..... 2018-198453

(51) Int. Cl.
*B41J 11/00* (2006.01)
*B41J 13/10* (2006.01)

(52) U.S. Cl.
CPC ..... *B41J 11/002* (2013.01); *B41J 11/0005* (2013.01); *B41J 13/106* (2013.01)

(58) Field of Classification Search
CPC ..... B41J 11/002; B41J 11/0005; B41J 13/106
See application file for complete search history.

(56) References Cited

U.S. PATENT DOCUMENTS

2011/0234672 A1 9/2011 Ohtsu et al.
2016/0167401 A1* 6/2016 Ebihara ..... B41J 11/002 347/102

(Continued)

FOREIGN PATENT DOCUMENTS

JP 2011-068485 4/2011
JP 20114 94888 10/2011
JP 2013-144375 7/2013

*Primary Examiner* — Lamson D Nguyen
(74) *Attorney, Agent, or Firm* — Oblon, McClelland, Maier & Neustadt, L.L.P.

(57) ABSTRACT

A liquid discharge apparatus includes a conveyance path, a liquid discharge head, an ejection tray, and a drying device. A medium is conveyed in the conveyance path. The liquid discharge head discharges liquid onto the medium conveyed in the conveyance path. The medium is ejected to the ejection tray. The drying device dries the medium. The conveyance path includes a first bending portion to bend the medium, with a liquid-applied surface of the medium facing inward. The ejection tray includes a second bending portion to bend the medium, with the liquid-applied surface of the medium facing inward. A curvature of the medium bent by the first bending portion is greater than a curvature of the medium bent by the second bending portion. The drying device dries the medium conveyed in the first bending portion.

10 Claims, 10 Drawing Sheets

(56) References Cited

U.S. PATENT DOCUMENTS

| | | | | |
|---|---|---|---|---|
| 2018/0015737 | A1 | 1/2018 | Harada et al. | |
| 2018/0015747 | A1* | 1/2018 | Kodama | B65H 29/125 |
| 2019/0366739 | A1* | 12/2019 | Somano | B65H 29/00 |

* cited by examiner

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-050261, filed on Mar. 16, 2018, and Japanese Patent Application No. 2018-198453, filed on Oct. 22, 2018, in the Japan Patent Office, the entire disclosure of which is incorporated by reference herein.

BACKGROUND

Technical Field

The present disclosure relates to a liquid discharge apparatus.

Related Art

Regarding a liquid discharge apparatus, there is a disclosed configuration in which a drying device is provided in a conveyance path for a medium so that liquid adhering to the medium is dried. There is also a disclosed configuration in which the sheet ejection tray is made to have unevenness to bend a medium and reduce curling.

SUMMARY

In an aspect of the present disclosure, there is provided a liquid discharge apparatus that includes a conveyance path, a liquid discharge head, an ejection tray, and a drying device. A medium is conveyed in the conveyance path. The liquid discharge head discharges liquid onto the medium conveyed in the conveyance path. The medium is ejected to the ejection tray. The drying device dries the medium. The conveyance path includes a first bending portion to bend the medium, with a liquid-applied surface of the medium facing inward. The ejection tray includes a second bending portion to bend the medium, with the liquid-applied surface of the medium facing inward. A curvature of the medium bent by the first bending portion is greater than a curvature of the medium bent by the second bending portion. The drying device dries the medium conveyed in the first bending portion.

In another aspect of the present disclosure, there is provided a liquid discharge apparatus that includes a conveyance path, a liquid discharge head, an ejection tray, and a drying device. A medium is conveyed in the conveyance path. The liquid discharge head discharges liquid onto the medium conveyed in the conveyance path. The medium is ejected to the ejection tray. The drying device dries the medium. The conveyance path includes a first bending portion to convey the medium between a start point and an end point while bending the medium, with a liquid-applied surface of the medium facing inward. The ejection tray includes a second bending portion to bend the medium, with the liquid-applied surface of the medium facing inward, the second bending portion being raised from a surface of the ejection tray. A relation of $(a1/b1)>(a2/b2)$ is satisfied, where a1 represents a distance from a line segment connecting the start point and the end point to a portion of the first bending portion farthest from the line segment, the distance being in a direction perpendicular to the line segment, b1 represents a distance between the start point and the end point of the first bending portion, a2 represents a distance from the surface of the ejection tray to a top end portion of the second bending portion in a direction in which the second bending portion is raised, and b2 represents a distance from one end to the other end of the medium in a sheet width direction of the medium in the second bending portion. The drying device dries the medium being conveyed in the first bending portion.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
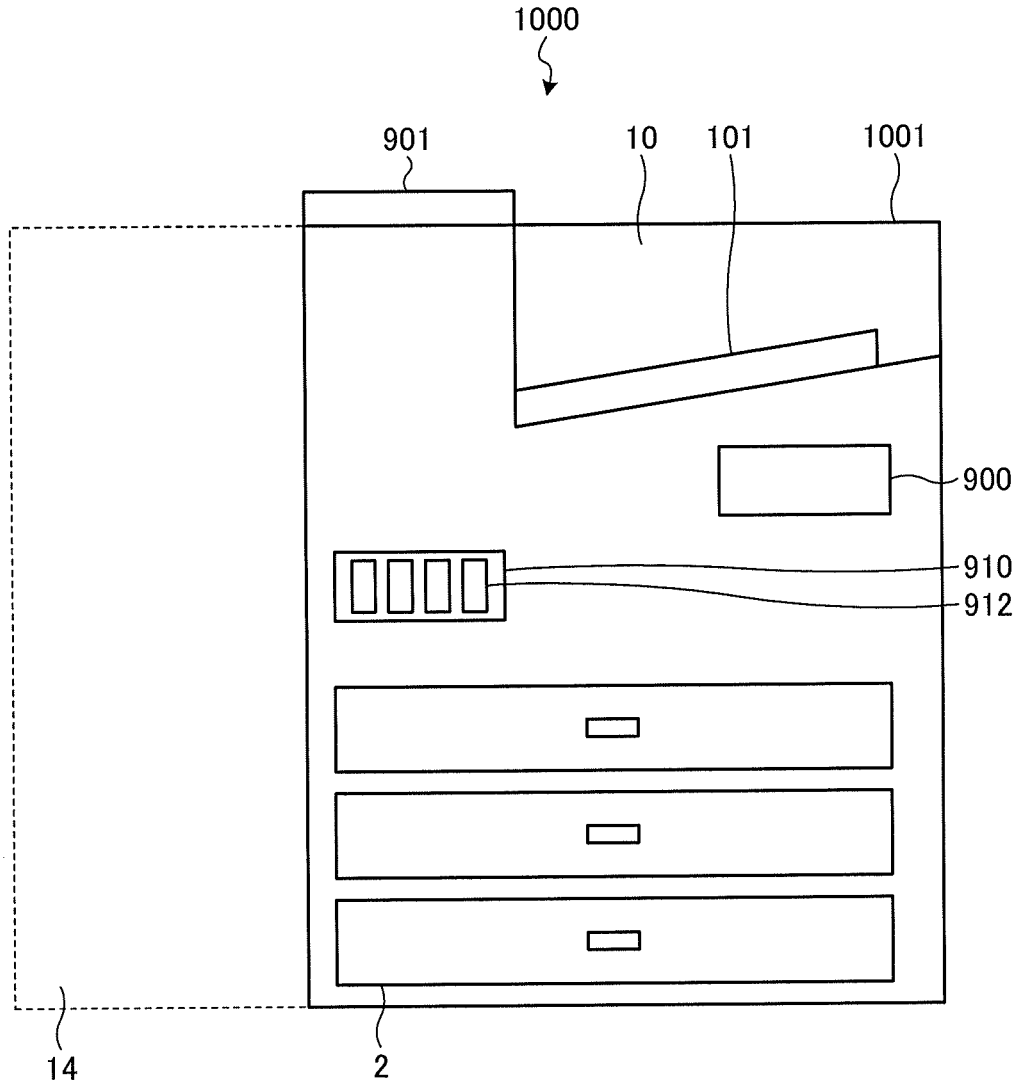
FIG. 1 is a schematic view of an entire liquid discharge apparatus (image forming apparatus)

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

First Embodiment

Figure 2:
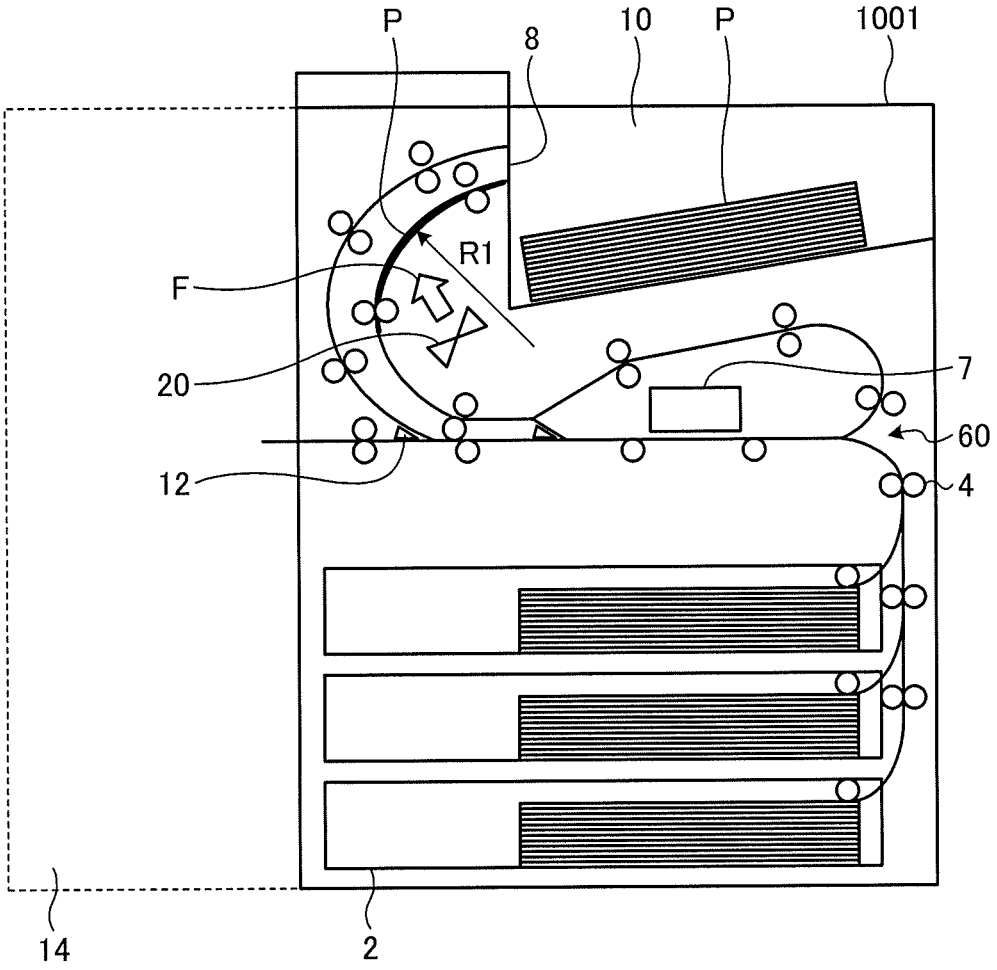
FIG. 2 is a schematic view of the inside of the liquid discharge apparatus (image forming apparatus)

Referring to FIGS. 1 and 2, an outline of a liquid discharge apparatus (image forming apparatus) 1000 is described. The liquid discharge apparatus 1000 includes an apparatus main body 1001, a sheet feed tray 2, a sheet ejection tray 10, an operating unit 900, an auto document feeder (ADF) 901, a cartridge holder 910, cartridges 912, and a post-processing device 14.

The sheet feed tray 2 stores paper sheets P (media). The sheet ejection tray 10 is the ejection destination of a paper sheet P on which an image or the like is formed with the liquid discharge head described later. A raised portion 101 (a second bending portion) that is not illustrated in FIG. 2 is formed on the sheet ejection tray 10. The raised portion 101 will be described later in detail with reference to FIGS. 5 and 6. The operating unit 900 includes a touch panel, physical buttons, and the like. A user can issue a print instruction or the like to the main body of the apparatus via the operating unit 900. The ADF 901 is a scanner device.

The cartridges 912 are liquid storage containers that store the liquid (ink or the like) to be discharged by the liquid discharge head, and are mounted on the cartridge holder 910. The liquid in the cartridges 912 is sent to the liquid discharge head via a tube or the like. The post-processing device 14 is a device that binds paper sheets with a stapler or folds paper sheets.

FIG. 2 is a diagram illustrating the internal configuration of the apparatus main body 1001. The apparatus main body 1001 includes conveyance rollers 4, a conveyance path 60, a drying device 20, a liquid discharge head 7, an ejection port 8, and a switching portion 12.

The conveyance rollers 4 are rollers for conveying paper sheets P in a conveyance direction on the sheet feed tray 2 and in the conveyance path 60. The conveyance rollers 4 are formed with a combination of rollers, including a roller that can be rotatively driven by a drive source such as a motor, and a roller that does not have any driving force and is simply engaged with a bearing (in this embodiment, the rollers are not distinguished from one another).

The conveyance path 60 is a path for conveying paper sheets P on the sheet feed tray 2, and is designed so that a paper sheet P is ejected from the ejection port 8 after having passed through the portion below the liquid discharge head 7. The drying device 20 is a device that dries paper sheets P being conveyed in the conveyance path 60, and specifically, is a blowing device or the like. The conveyance path 60 and the drying device 20 will be described later in detail, with reference to FIGS. 3 and 4.

The liquid discharge head 7 is a portion for discharging liquid onto a paper sheet P in the conveyance path 60, and may be a piezoelectric inkjet head using a piezoelectric element, a thermal inkjet head using heat, or the like. Further, in this embodiment, a so-called line inkjet head (or a one-pass inkjet head) in which a plurality of liquid discharge heads are arranged in a direction perpendicular to the conveyance direction of the paper sheets P is used.

The switching portion 12 is a claw for switching conveyance directions of the paper sheets P, and guides a paper sheet P onto which the liquid has been discharged to the post-processing device 14, guides the paper sheet P to the ejection port 8, or guides the paper sheet P to the later described switchback path 61.

Figure 3:
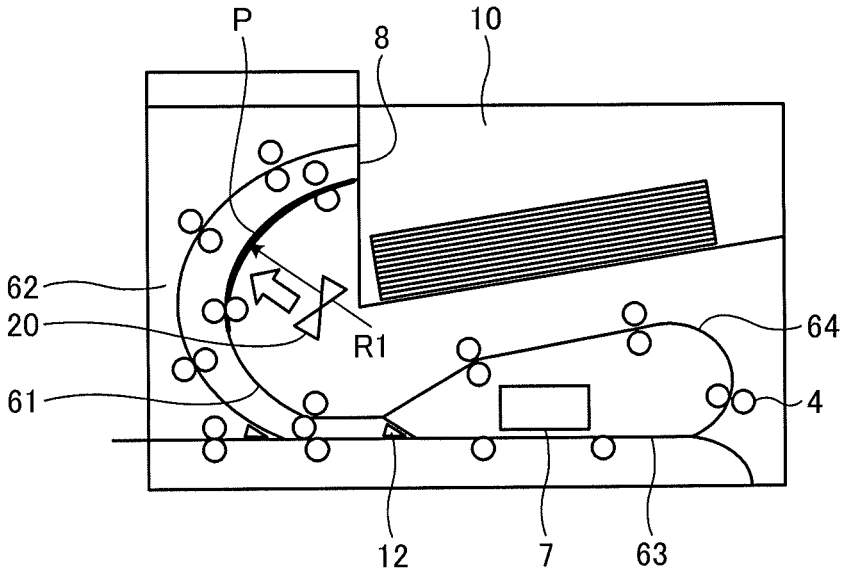
FIG. 3 is a detailed explanatory diagram of the conveyance path and the components surrounding the conveyance path according to the first embodiment.
Figure 4:
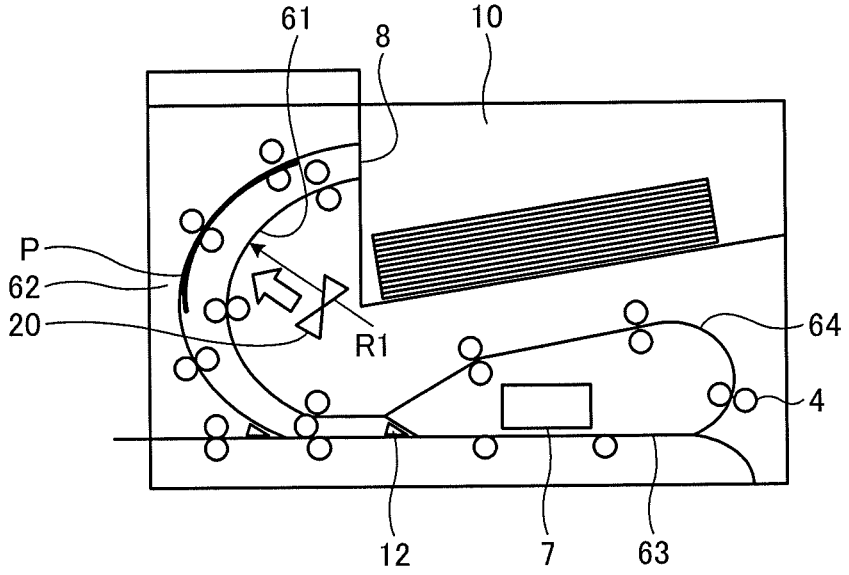
FIG. 4 is a detailed explanatory diagram of the conveyance path and the components surrounding the conveyance path according to the first embodiment.

Next, the conveyance path 60 and a method of drying a paper sheet according to this embodiment are described in greater detail, with reference to FIGS. 3 and 4.

FIGS. 3 and 4 are enlarged views of the conveyance path 60 and the region surrounding the conveyance path 60 illustrated in FIG. 2. The conveyance path 60 includes the switchback path 61 (a first bending portion), an ejection path 62 (the first bending portion), an above-the-head path 64, and a discharge path 63. The switchback path 61 included in the conveyance path 60 is a path for bending a paper sheet P onto which liquid has been discharged with the liquid-applied surface of the paper sheet P facing inward, and for reversing a paper sheet P.

When a paper sheet P is to be reversed, the switching portion 12 located on the downstream side of the liquid discharge head 7 in the conveyance direction of the paper sheet P is activated, to guide the paper sheet P onto which liquid has been discharged into the switchback path 61. After the paper sheet P reaches the vicinity of the end portion of the switchback path 61 (near the ejection port 8), the driving of the conveyance rollers 4 is reversed, for example, to convey the paper sheet P to the upstream side. When the paper sheet P reaches the vicinity of the end portion of the switchback path 61 (near the ejection port 8), the paper sheet P is bent along the switchback path 61 as illustrated in FIG. 3.

After that, the paper sheet P is conveyed to the discharge path 63 via the above-the-head path 64 located above the liquid discharge head 7. As described above, it is possible to reverse the conveyance direction and the front and back of the paper sheet P.

After discharge of the liquid onto one side or both sides of the paper sheet P is completed, the paper sheet P is guided into the ejection path 62 (FIG. 4). The ejection path 62 is a path connecting the liquid discharge head 7 and the ejection port 8, and the paper sheet P is ejected from the ejection port 8 onto the sheet ejection tray 10.

In this embodiment, the sheet ejection tray 10 is disposed above the liquid discharge head 7 in the vertical direction. Therefore, the ejection path 62 is disposed in a curved (warped) manner in a direction away from the liquid discharge head 7 in the region from the downstream side of the liquid discharge head 7 to the ejection port 8. Further, the switchback path 61 is disposed adjacent to (along) the ejection path 62.

Thus, the switchback path 61 and the ejection path 62 can be accommodated in a small space.

In the vicinity of the conveyance path 60, the above mentioned drying device 20 (the dryer) is also disposed. Specifically, the drying device 20 is disposed at a position facing the switchback path 61 and the ejection path 62. The drying device 20 is a device for drying liquid adhering to a paper sheet P. Examples of such devices include a device that dries a paper sheet P by rotating a fan or the like and sending air, and a device that dries a paper sheet P by heating the paper sheet P with the heating unit of a heater or the like. It is of course possible to combine those devices. The dryer also includes a hardener that hardens liquid with an ultraviolet (UV) lamp or the like. In this embodiment, the drying device 20 is a blowing device that sends air by rotating a fan.

Here, the drying device 20 dries a paper sheet P in the switchback path 61 and a paper sheet P in the ejection path 62. In other words, the drying device 20 is disposed so as to be able to dry a paper sheet P in the switchback path 61 and a paper sheet P in the ejection path 62. More specifically, the switchback path 61 and the ejection path 62 are disposed in the direction of air blowing by the drying device 20 (or the direction of heating energy emission by the heating unit; here, the directions are collectively referred to as the drying energy supply direction F).

With this arrangement, the drying energy from the drying device 20 is supplied to both the paper sheet P located in the switchback path 61 and the paper sheet P located in the ejection path 62. Thus, it is possible to widen the range in which paper sheets P can be subjected to the drying energy in the conveyance path 60, and improve drying efficiency.

Further, in this embodiment, the switchback path 61 is located closer to the drying device 20 than the ejection path 62 in the direction F of drying energy supply by the drying device 20. In other words, the drying device 20 is disposed to face the ejection path 62, with the switchback path 61 being interposed in between. With this arrangement, a paper sheet P conveyed into the switchback path 61 during two-side printing can be quickly dried, and more efficient drying can be performed.

Note that it has become apparent that the liquid applied to a paper sheet P penetrates into the paper sheet P and causes the paper sheet P to swell primarily at the liquid-applied surface side in the course of the penetration, and the paper sheet P curls (warps) so that the liquid-applied surface side is raised.

Therefore, in this embodiment, the switchback path 61 and the ejection path 62 are designed to bend so as to protrude in the direction F of drying energy supply by the drying device 20 (so that the downstream side in the direction F of drying energy supply is raised), and convey a paper sheet P while causing the paper sheet P to bend inward at the liquid-applied surface side, as illustrated in FIG. 3 and other drawings. That is, the switchback path 61 conveys a paper sheet P so that the liquid-applied surface of the paper sheet P faces the drying device 20. Likewise, the ejection path 62 conveys a paper sheet P so that the liquid-applied surface of the paper sheet P faces the drying device 20. With this arrangement, the drying energy from the drying device 20 is supplied to the liquid-applied surface side of each paper sheet P.

Further, by virtue of this arrangement, the switchback path 61 can bend a paper sheet P, with the liquid-applied surface of the paper sheet P facing inward. In other words, the switchback path 61 bends (warps) a paper sheet P in the opposite direction from the direction in which the paper sheet P was originally about to curl with its liquid-applied surface side being raised. By doing so, the switchback path 61 corrects the curling of the paper sheet P. While this correction is being performed, the drying energy is supplied to the liquid-applied surface side, to further correct the curling. Note that "curling" is almost synonymous with "warpage", and its meaning includes "wrinkling" and "wear", for example. That is, curling of a paper sheet P means a state in which the paper sheet P is curved, and the liquid-applied surface side swells (is raised).

In this example, the curvature of a paper sheet P at a time when the switchback path 61 (the first bending portion) bends the paper sheet P is represented by 1/R1 (R1 representing the radius of the curved portion). Note that the curvature represented by 1/R1 is the largest among the curvatures to be given to the paper sheet P. Although the curvature of the switchback path 61 and the curvature of the ejection path 62 are substantially the same in this embodiment, the two curvatures may be different from each other.

Figure 5:
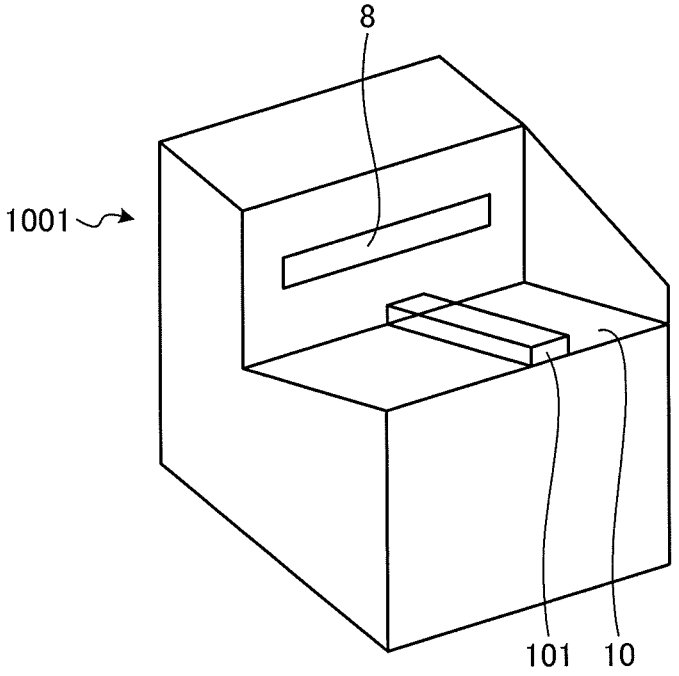
FIG. 5 is a perspective view of the sheet ejection tray according to the first embodiment.
Figure 6:
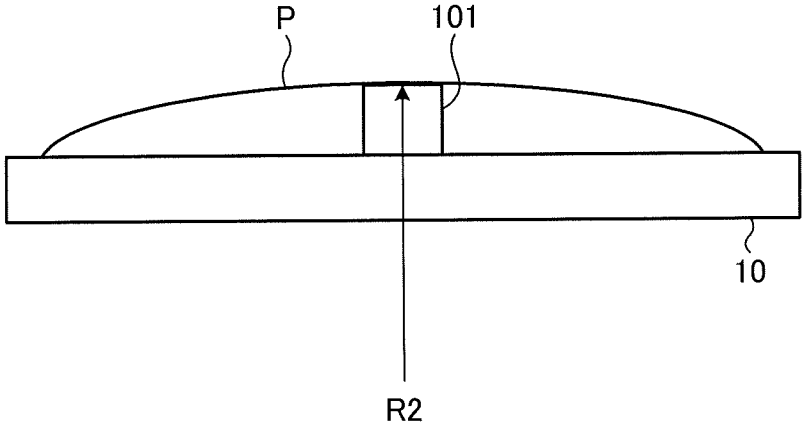
FIG. 6 is a front view of the sheet ejection tray according to the first embodiment.

Referring now to FIGS. 5 and 6, the raised portion 101 (the second bending portion) of this embodiment is described in detail.

FIG. 5 is a perspective view of the apparatus main body 1001. The apparatus main body 1001 includes the raised portion 101, in addition to the ejection port 8 and the sheet ejection tray 10 described above. The raised portion 101 is a member that is raised upward from the surface of the sheet ejection tray 10 and is designed to bend a paper sheet P. The raised portion 101 is also provided as a long rectangle extending in the direction of ejection of paper sheets P, in the vicinity of the center of the sheet ejection tray 10 in the width direction of paper sheets P (or in a direction perpendicular to the sheet ejection direction).

FIG. 6 is a view of the structure in the vicinity of the raised portion 101 as viewed from the conveyance direction of paper sheets P. A paper sheet P ejected from the ejection port 8 is stacked so that the center portion of the paper sheet P in the width direction is brought into contact with the upper edge of the raised portion 101. As a result, the paper sheet P can be bent (warped), with the liquid-applied surface of the paper sheet P facing inward as illustrated in FIG. 6. The curvature of the paper sheet P at a time when the raised portion 101 (the second bending portion) bends the paper sheet P is represented by 1/R2 (R2 representing the radius of the curved portion). Note that, in this example, the curvature in the vicinity of the center portion of the paper sheet P in the width direction is represented by 1/R2.

Further, the ejection path 62 is designed so as to extend to the sheet ejection tray 10 while reversing a paper sheet P onto which the liquid is discharged. Accordingly, a paper sheet P ejected onto the sheet ejection tray 10 is ejected with the liquid-applied surface facing down (face-down sheet ejection). Therefore, the bending of a paper sheet P by the raised portion 101 (the second bending portion) is in such a bending direction that the liquid-applied surface faces inward, like the direction of bending by the switchback path 61 (the first bending portion).

In this embodiment, the curvature of a paper sheet P bent by the switchback path 61 (the first bending portion) and the ejection path 62 (the first bending portion) is greater than the curvature of a paper sheet P bent by the raised portion 101 (the second bending portion). That is, $(1/R1)>(1/R2)$ is satisfied, where 1/R1 represents the curvature of a paper sheet P bent by the switchback path 61 (the first bending portion) and the ejection path 62 (the first bending portion), and 1/R2 represents the curvature of a paper sheet P bent by the raised portion 101 (the second bending portion). In other words, the bending by the first bending portion is greater than the bending by the second bending portion. Because of this, curling can be reduced more efficiently. The reason of that is described below.

As described above, it has become apparent that the liquid applied to a paper sheet P penetrates into the paper sheet P and causes the paper sheet P to swell primarily at the liquid-applied surface side in the course of the penetration, and the paper sheet P curls (warps) so that the liquid-applied surface side is raised. This curling is referred to as "back curl" in this example.

On the other hand, it has also become apparent that, if a paper sheet P that has absorbed liquid is allowed to stand for a certain time (several hours), the paper sheet P curls in the opposite direction from the direction of back curl (or the paper sheet P curls, with the liquid-applied surface side being raised). This curling is referred to as "face curl" in this example.

In particular, a paper sheet P ejected onto the sheet ejection tray 10 is likely to be left for a long time when continuous printing is performed or when the user leaves the apparatus, and "face curl" often occurs particularly in such a case. Further, at a time of one-side printing, the amount of liquid adhering to the front surface of a paper sheet P differs from the amount of liquid adhering to the back surface of the paper sheet P, and therefore, the curling is likely to be large. Even if any face curl does not occur, the back curl immediately after printing gradually decreases with time.

Figure 7:
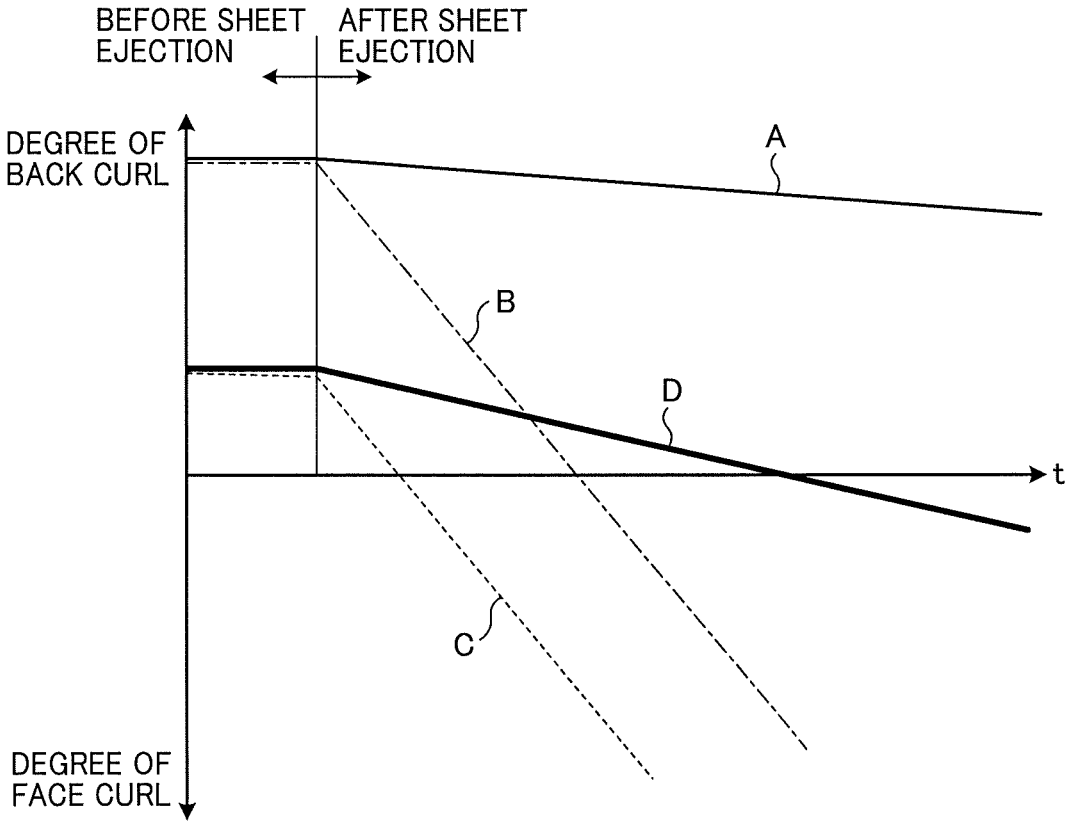
FIG. 7 is a graph illustrating the relationship between the elapsed time, and the degree of curing and the curling direction.

FIG. 7 is a graph illustrating the relationship between the curling direction and the curling orientation of a paper sheet P onto which liquid has been discharged, and the lapse of time. The ordinate axis indicates the curling direction and the curling orientation. The upper side means back curl, and the lower side means face curl. Although the description below is based on the findings and observations of the inventor, the description below does not limit the principles of achievement of effects. The size and the transition of curling may vary depending on the materials and the thicknesses of paper sheets, ink components, and the like.

A line A indicated by a solid line represents an example case where correction and drying were not performed after liquid was discharged onto a paper sheet P. As described above, since large back curl occurs immediately after ink discharge, the user takes out a curled paper sheet. Furthermore, it is not realistic to leave paper sheets on the sheet ejection tray for several hours until the curling becomes small.

A line B indicated by a dot-and-dash line represents an example case where each paper sheet P was corrected only with the second bending portion (the raised portion 101) after liquid was discharged onto the paper sheet P and was ejected onto the sheet ejection tray. In this case, a sufficient effect to reduce curling (back curl) immediately after ink discharge can be achieved. However, face curl appears over time, and the direction of correcting a paper sheet P with the second bending portion becomes a direction to increase face curl. As a result, the curling of the paper sheet P might become larger. In other words, the time when the curling becomes smaller than in the case represented by the line A is only slightly shifted. In a case where the user takes a long time to collect paper sheets, the curling might become larger than in the case represented by the line A. The curling is of course also large in a case where paper sheets are collected too quickly. As described above with the line A and the line B, there is a possibility that a problem may occur in a case where the sheet correcting force is too small or too large.

A line C indicated by a dashed line represents the curling in a case where correction is performed by bending while air is further sent to a paper sheet to dry the paper sheet at the first bending portion, as compared with the case of the line B. Note that the curvature of the first bending portion and the curvature of the second bending portion are the same at this point of time. In this example, it is possible to obtain a great curl correcting force by correcting a paper sheet while drying the paper sheet at the first bending portion, and the curling immediately after the paper sheet is ejected is smaller than in the above described case. However, since the curvature of the second bending portion is equal to that of the first bending portion (the curvature is relatively great), appearance of back curl is accelerated thereafter. Because of this, there is a high possibility that the paper sheet is greatly curled at a time immediately after the paper sheet is ejected.

A line D indicated by a bold line indicates the curling in a case where this embodiment is adopted. In this embodiment, $(1/R1)>(1/R2)$ is satisfied, so that the amount of correction to be performed on a paper sheet P by the second bending portion becomes smaller than the amount of correction to be performed by the first bending portion. As a result, even when face curl appears in a paper sheet P ejected onto the sheet ejection tray 10 over time, and the direction of correction performed on the paper sheet P by the second bending portion becomes a direction to increase the face curl, curling is not easily accelerated, because the correcting force is small. In other words, it is possible to reduce the curling both immediately after and a long time after a paper sheet is ejected.

Further, even if any face curl does not appear, the back curl gradually decreases. As a result, if the amount of correction to be performed on a paper sheet P by the second bending portion is smaller than the amount of correction to be performed by the first bending portion, the amount of correction by the second bending portion is an appropriate amount of correction for the reduced curling. Thus, the curling can be efficiently reduced.

Since the amount of correction to be performed on a paper sheet P by the first bending portion is larger than the amount of correction to be performed by the second bending portion, a paper sheet P that primarily has back curl can be corrected with a greater force.

To further correct back curl having a relatively high degree of curling, the drying device 20 is disposed so as to dry a paper sheet P being conveyed in the switchback path 61 (or the ejection path 62). With these configurations, a large curvature obtained by satisfying $(1/R1)>(1/R2)$ and the drying performed by the drying device 20 are combined for back curl having a relatively high degree of curling that is likely to occur immediately after printing. As a result, a greater correcting force is obtained. Meanwhile, for face curl having a relatively low degree of curling that appears after that, correction is performed with a small curvature obtained by satisfying $(1/R1)>(1/R2)$, and thus, an appropriate correcting force is obtained. In this manner, curling can be efficiently reduced.

Note that, even if any face curl does not appear, the back curl gradually decreases over time. As a result, if the amount of correction to be performed on a paper sheet P by the second bending portion is smaller than the amount of correction to be performed by the first bending portion (and the drying device 20), the amount of correction by the second bending portion is an appropriate amount of correction for the reduced curling. Thus, the curling can be efficiently reduced.

Meanwhile, the raised portion 101 is preferably made movable in the vertical direction, and is preferably moved downward over time so that the curvature given to the paper sheet P becomes smaller. As a result, it is possible to reduce the correcting force in accordance with the face curl occurring with time and the back curl decreasing with time, and it is possible to achieve a more efficient curl reducing effect.

Figure 8:
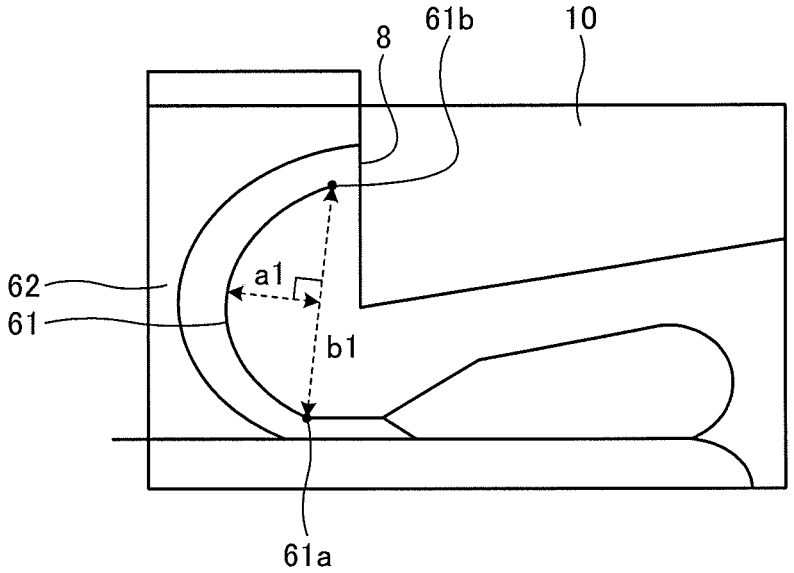
FIG. 8 is a detailed explanatory diagram of the conveyance path and the components surrounding the conveyance path according to the first embodiment.
Figure 9:
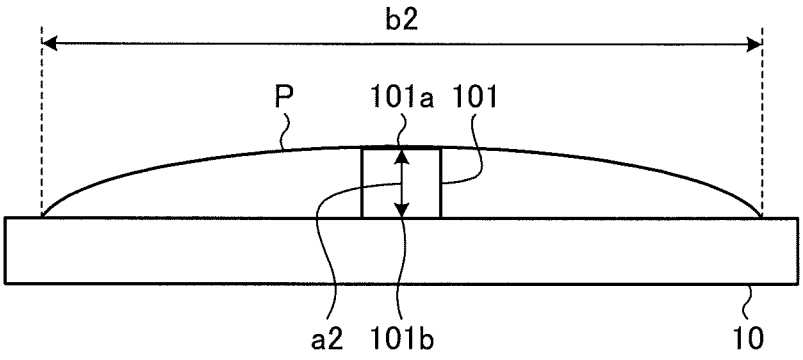
FIG. 9 is a front view of the sheet ejection tray according to the first embodiment.

In this embodiment, the strength of bending of a paper sheet P has been described through the curvature given to the paper sheet P. Referring now to FIGS. 8 and 9, the strength of bending of a paper sheet P is described through the structures of the respective components included in the apparatus main body 1001.

FIG. 8 is a diagram illustrating the structure of the switchback path 61 as the first bending portion (part of the structure described above is not illustrated in this diagram). The switchback path 61 is formed with a path connecting a start point 61*a* and an end point 61*b*. Here, the start point 61*a* is the position where the conveyance direction of a paper sheet P changes from a horizontal direction to an upward direction. The end point 61*b* is the position of the end portion of the paper sheet P in the conveyance direction when the paper sheet P is reversed (more specifically, when the conveyance velocity of the paper sheet P becomes 0).

In a direction perpendicular to the line segment connecting the start point 61*a* and the end point 62*b*, the distance to the portion of the switchback path 61 that is the farthest from the line segment is represented by a1. The distance between the start point 61*a* and the end point 62*b* of the first bending portion 61 is represented by b1. In this case, a1/b1 is equivalent to the strength of bending caused by the first bending portion.

In this case, the switchback path 61 is used as the first bending portion. However, in a case where the first bending portion is the ejection path 62, the start point may be the position where the conveyance direction of a paper sheet P changes from a horizontal direction to an upward direction (for example, the position where the switching portion 12 is formed), and the end point may be the position of the ejection port 8.

Like FIG. 6, FIG. 9 is a view of the structure in the vicinity of the raised portion 101 as viewed from the conveyance direction of paper sheets P. The distance from the surface 101*b* (the bottom of the raised portion 101) of the sheet ejection tray 10 to the top end portion 101*a* of the raised portion 101 in the direction in which the raised portion 101 is raised is represented by a2. The distance from one end to the other end of a paper sheet P in the width direction of the paper sheet P on the raised portion 101 is represented by b2. In this case, a2/b2 is equivalent to the strength of bending caused by the second bending portion.

The respective components are designed to satisfy (a1/b1)>(a2/b2), so that the above described curl reducing effect can be achieved. Further, where the start point and the end point of the ejection path 62 are represented by a1 and b1, respectively, and the start point and the end point of the switchback path 61 are represented by a0 and b0, respectively, (a0/b0)>(a1/b1)>(a2/b2) is satisfied, so that the curl correcting force can vary in a more stepwise manner, and curling can be reduced more efficiently.

Meanwhile, the raised portion 101 is preferably made movable in the vertical direction, and is preferably moved downward over time so that the curvature given to the paper sheet P becomes smaller. In other words, it is desirable to set a2 so that a2 decreases with time. As a result, it is possible to reduce the correcting force in accordance with the face curl occurring with time and the back curl decreasing with time, and it is possible to achieve a more efficient curl reducing effect.

Note that it is clear that the above described curling of a paper sheet becomes larger as the amount of moisture contained in the liquid (ink) becomes larger. On the contrary, the curling is small when the ink does not contain a large amount of moisture (an ink containing about 20% by mass of moisture, for example). Therefore, curling in the reverse direction might be caused depending on conditions, if combined with this embodiment (this does not exclude the possibility of a combination though). Particularly, in a case where the curvature of the switchback path is small, the influence of reverse curling is significant.

In view of this, it is particularly preferable to use an ink containing at least 50% by mass of moisture. As an ink containing at least 50% by mass of moisture is combined with this embodiment, curling can be reduced while an ink containing a large amount of moisture is discharged. An ink containing at least 50% by mass of moisture has a low viscosity and advantageously stabilizes the liquid discharge from the liquid discharge head 7 (for example, discharge can be performed at a high frequency).

Further, as illustrated in FIG. 3 and others, not only the switchback path 61 but also the ejection path 62 is disposed so as to protrude in the direction of supply of the drying energy generated by the drying device 20. With this arrangement, the reverse curling described above can also be reduced in the ejection path 62.

Figure 10:
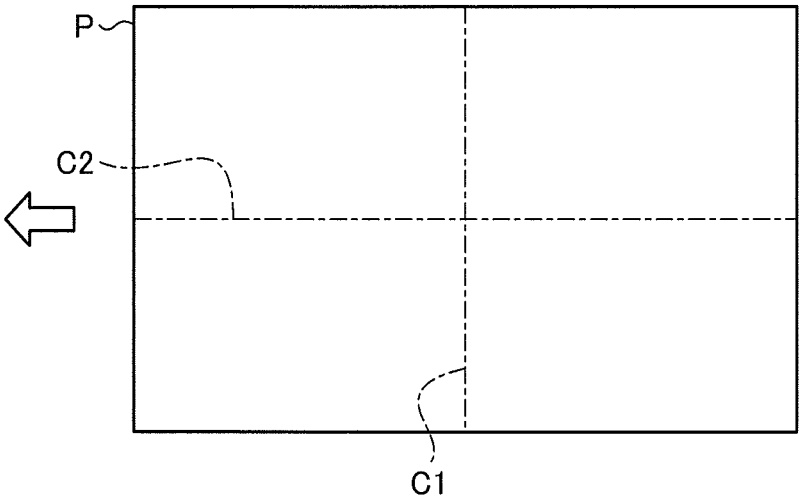
FIG. 10 is a detailed explanatory diagram relating to the direction of paper sheet bending according to the first embodiment.

Referring now to FIG. 10, the direction of bending of a paper sheet P is described. FIG. 10 is a plan view of a paper sheet P being conveyed, and the paper sheet P is being conveyed in the conveyance direction indicated by an arrow X. The switchback path 61 or the ejection path 62 at this point of time bends the paper sheet P about an axis extending in a direction intersecting with the conveyance direction of the paper sheet P, and this axis (the first axis) can be represented by C1. This is because the switchback path 61 and the ejection path 62 are designed to vertically lift up a paper sheet P being conveyed in the conveyance direction X as described above.

Meanwhile, the raised portion 101 (the second bending portion) bends the paper sheet P about an axis extending in a direction parallel to the conveyance direction X of the paper sheet P, and this axis (the second axis) can be represented by C2. That is, C2 (the second axis) intersects with C1 (the first axis), and the raised portion 101 bends the paper sheet P about an axis extending in a direction intersecting with the bending axis C1 of the switchback path 61 (the first bending portion). This is because the raised portion 101 is provided as a long member in the conveyance direction X in the vicinity of the center portion in a direction perpendicular to the conveyance direction X, as described above.

With this arrangement, a paper sheet P can be bent (warped) about two axes, and the direction of correction for paper sheets becomes more multifaceted than in a case where a paper sheet is warped about a single axis. Thus, curling can be reduced more efficiently. Note that "bending a paper sheet about C1 as the axis" can be rephrased as "bending a paper sheet so that the paper sheet is raised as viewed from a direction perpendicular to the conveyance direction of the paper sheet". Likewise, "bending a paper sheet about C2 as the axis" can be rephrased as "bending a paper sheet so that the paper sheet is raised as viewed from the conveyance direction of the paper sheet (or from the ejection direction of the paper sheet)".

Second Embodiment

Figure 11:
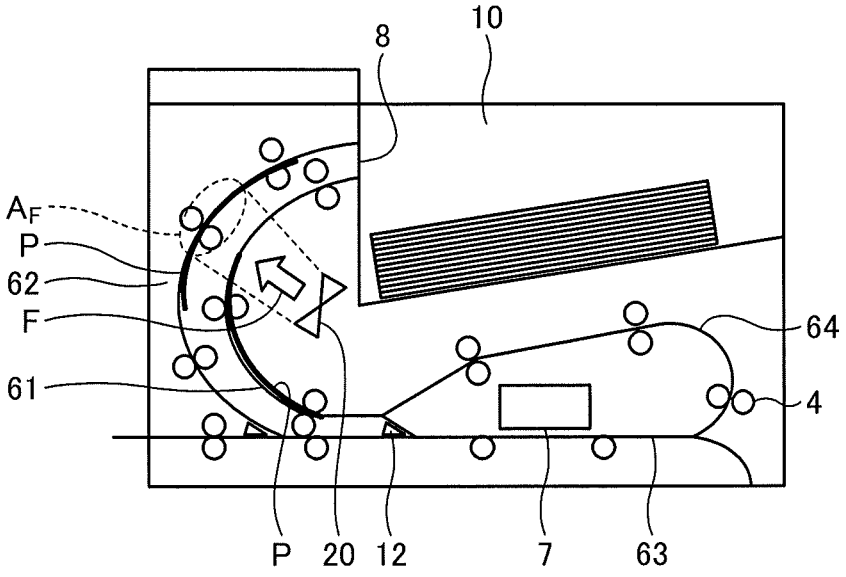
FIG. 11 is a detailed explanatory diagram of the conveyance path and the components surrounding the conveyance path according to a second embodiment.

Referring now to FIG. 11, a second embodiment is described. FIG. 11 is a schematic view of the apparatus main body of when printing is performed on a plurality of paper sheets.

For example, in a case where the user gives the apparatus main body an instruction to perform printing on a plurality of paper sheets, a plurality of paper sheets P are supposed to be located in the conveyance path 60 at the same time. In this case, when a paper sheet P exists in a range (referred to as the supplied range Af) to which the drying energy from the drying device 20 is supplied in the ejection path 62, the paper sheet P existing in the switchback path 61 covers the supplied range Af (in other words, the paper sheets P overlap each other on the line of supply of the drying energy), the paper sheet P existing in the ejection path 62 cannot be efficiently dried.

Therefore, this embodiment is designed so that, when a paper sheet P (a first medium) exists in the supplied range Af in the ejection path 62, a paper sheet P (a second medium) being conveyed in the switchback path 61 does not cover all the supplied range Af as viewed from the drying device 20. Note that, as illustrated in FIG. 11, "not covering all the supplied range Af" includes a mode in which the paper sheet P (second medium) being conveyed in the switchback path 61 covers part of the supplied range Af as viewed from the drying device 20, and a mode in which the paper sheet P (second medium) being conveyed in the switchback path 61 does not cover the supplied range Af at all as viewed from the drying device 20.

Specifically, the amount of driving of the conveyance rollers 4 is adjusted, or the lengths of the switchback path 61 and the ejection path 62 are adjusted, so that the amount of conveyance of the paper sheets is adjusted. In this manner, the above conveyance method becomes possible.

As a result, the possibility that the drying energy is blocked by the paper sheet P existing in the switchback path 61, and fails to reach the paper sheet P existing in the ejection path 62 is lowered, and thus, more efficient drying can be performed. Note that, to further improve the drying efficiency, the paper sheet P (second medium) being conveyed in the switchback path 61 is made not to overlap the supplied range Af at all as viewed from the drying device 20, when a paper sheet P (the first medium) exists in the supplied range Af in the ejection path 62. However, in a case where conveyance is performed without any overlapping, the conveyance time might become long. Therefore, the paper sheet P in the switchback path 61 may cover part of the supplied range Af as viewed from the drying device 20 as illustrated in FIG. 11, and receive part of the supply energy. In this manner, the print time can be shorted while the sheet drying efficiency is improved.

Further, in a case where a blowing device is used as the drying device 20, air is less likely to move around paper sheets P than heat or the like. Accordingly, the effect to improve the drying efficiency according to this embodiment is great.

Note that, in a case where a blowing device is used as the drying device 20, the "supplied range" can be an "air-blown range" or a "wind-receiving range". In a case where the drying device 20 sends hot wind, the "supplied range" can be a "radiated range" or a "heated range". In a case where a curing beam radiating device such as a UV lamp is used as the drying device 20, the "supplied range" can be a "radiated range" or the like. Thus, the "supplied range" does not limit any structure.

Third Embodiment

Figure 12:
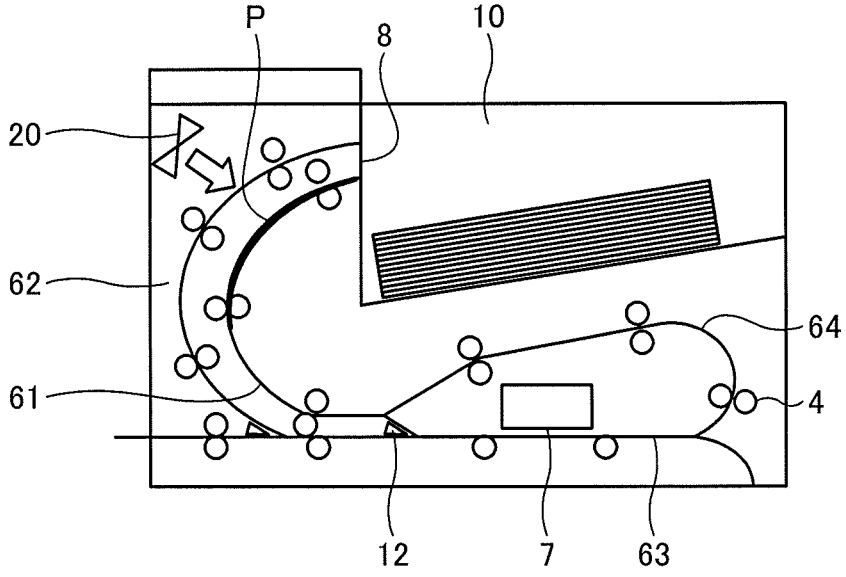
FIG. 12 is a detailed explanatory diagram of the conveyance path and the components surrounding the conveyance path according to a third embodiment.
Figure 13:
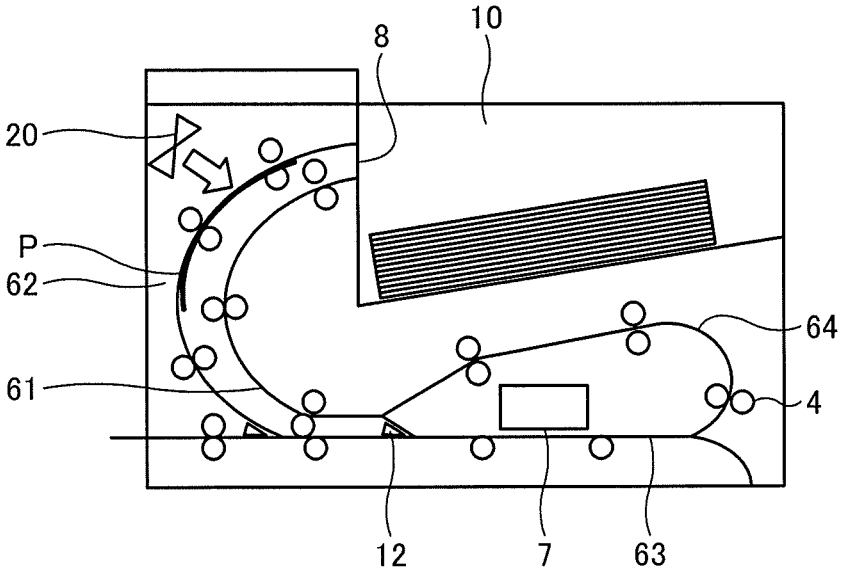
FIG. 13 is a detailed explanatory diagram of the conveyance path and the components surrounding the conveyance path according to the third embodiment.

Referring now to FIGS. 12 and 13, a third embodiment is described.

In this embodiment, the position of the drying device 20 is different from that in each of the above described embodiments. Specifically, the drying device 20 is disposed on the side opposite to the switchback path 61, with the ejection path 62 being interposed in between. The drying device 20 is designed to supply the supply energy to the side (the back surface) opposite from the liquid-applied surface side of each paper sheet P.

In a case where a large amount of liquid adheres to a paper sheet P, the liquid might move if strong wind is blown to the wet liquid immediately after printing. In that case, print quality might be degraded. This modification is effective in such a case, and it is possible to prevent movement of liquid by drying from the back.

Fourth Embodiment

Figure 14:
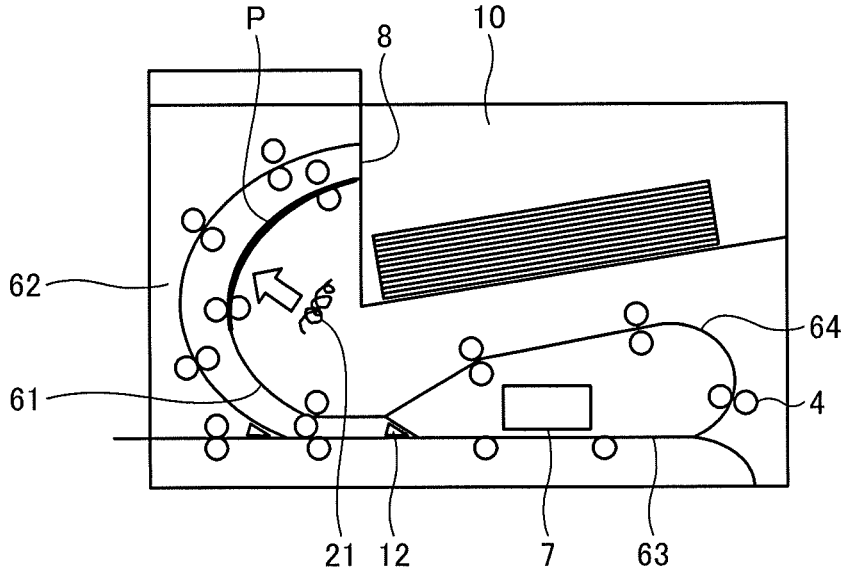
FIG. 14 is a detailed explanatory diagram of the conveyance path and the components surrounding the conveyance path according to a fourth embodiment.

Referring now to FIG. 14, a fourth embodiment is described.

In this embodiment, the drying device 20 in each of the above described embodiments is replaced with a heating device 21. The heating device 21 is formed with a heat transferring heater or the like, for example. Since most of the drying energy to be generated by the heating device 21 is thermal energy, heat can be transferred via the components (made of plastic, for example) constituting the switchback path 61. Accordingly, the drying energy easily reaches the back side of the switchback path 61 (or the side of the ejection path 62), and thus, more efficient drying can be performed, compared with a case with a blowing device using a fan.

Fifth Embodiment

Figure 15:
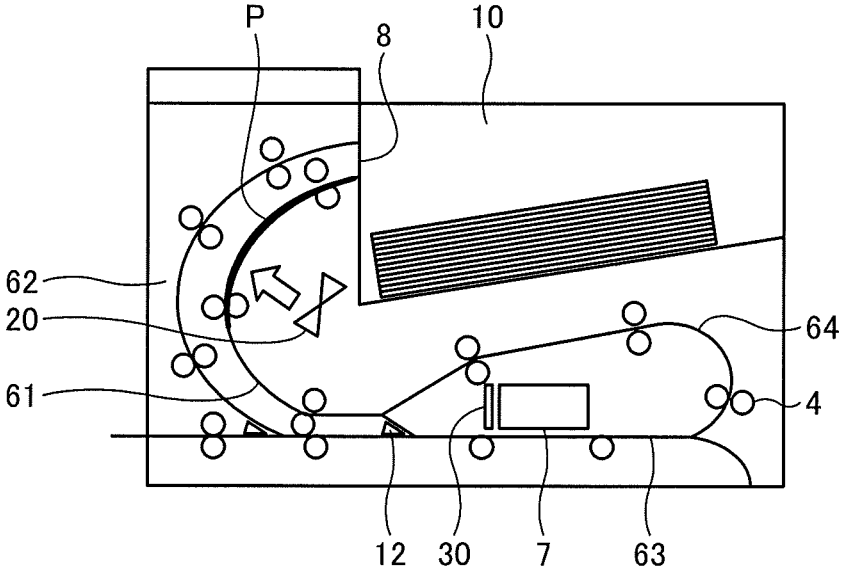
FIG. 15 is a detailed explanatory diagram of the conveyance path and the components surrounding the conveyance path according to a fifth embodiment.

Referring now to FIG. 15, a fifth embodiment is described.

In this embodiment, a shielding portion 30 is added to the above described structure of the first embodiment. The shielding portion 30 is provided as a long member in the width direction of paper sheets P on the downstream side of the liquid discharge head 7 in the conveyance direction of paper sheets P. With this arrangement, the possibility that the drying energy generated by the drying device 20 is reflected to reach a portion near the liquid discharge head 7, and affects liquid discharge can be lowered.

Sixth Embodiment

Figure 16:
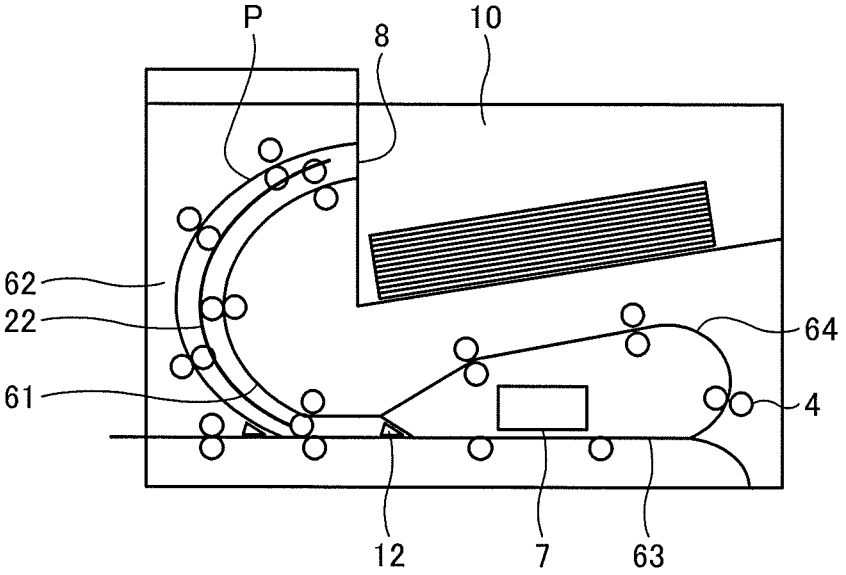
FIG. 16 is a detailed explanatory diagram of the conveyance path and the components surrounding the conveyance path according to a sixth embodiment.

Referring now to FIG. 16, a sixth embodiment is described.

This embodiment differs from each of the above described embodiments in that a heating device 22 is provided as the dryer. The heating device 22 is disposed adjacent to both the switchback path 61 and the ejection path 62 (or is disposed so as to be interposed between the switchback path 61 and the ejection path 62). With this arrangement, the drying energy generated by the heating device 22 can be applied not only to the switchback path 61 but also to the ejection path 62, and thus, more efficient drying can be performed.

Seventh Embodiment

Figure 17:
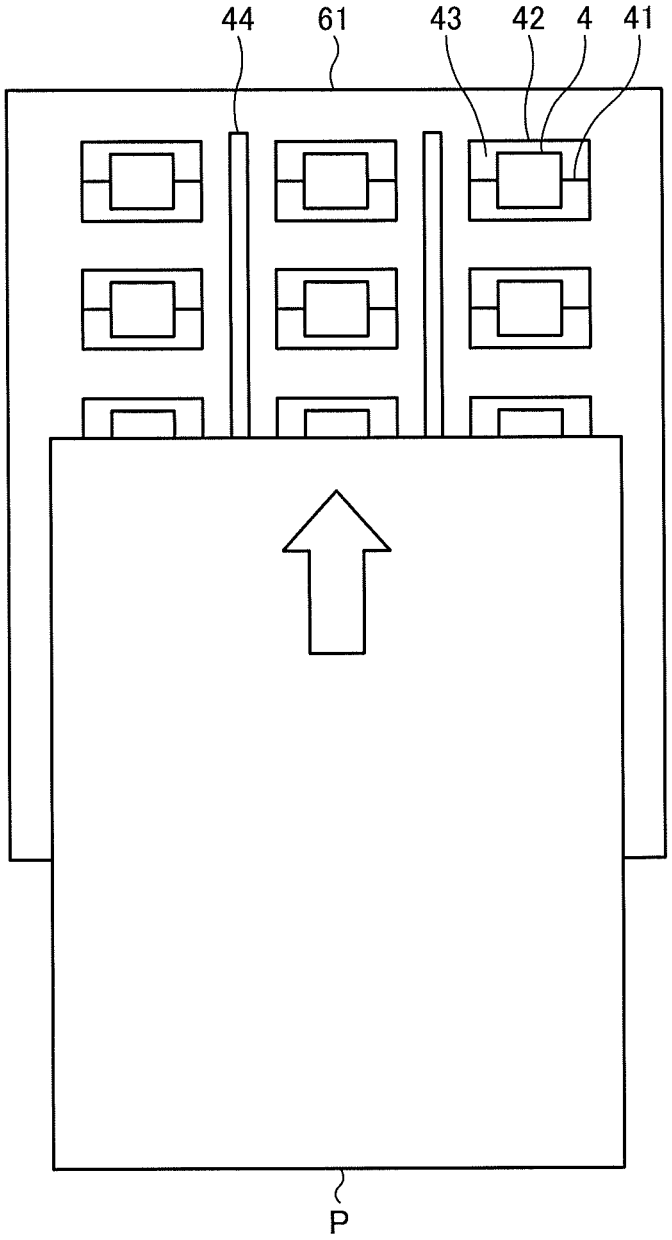
FIG. 17 is a plan view of the conveyance path according to a seventh embodiment.

Referring now to FIG. 17, a seventh embodiment is described.

FIG. 17 is a plan view (a view from a direction perpendicular to the surfaces of a paper sheet P) of the switchback path 61 (the curvature of the switchback path 61 is not taken into consideration).

The switchback path 61 includes the above described conveyance rollers 4 and hole portions 42. The hole portions 42 are spaces for holding the conveyance rollers 4. As the inner peripheral portions of the hole portions 42 hold shafts 41 extending from the conveyance rollers 4, a narrow opening 43 is formed between the inner wall of each hole portion 42 and each corresponding conveyance roller 4. With this arrangement, the drying energy generated by the drying device 20 can pass through the hole portions 42 (or the narrow openings 43 between the conveyance rollers 4 and the hole portions 42). Thus, the drying energy can be made to reach the ejection path 62 more efficiently.

Even if hole portions 44 are further formed at portions not related to the holding of the conveyance rollers 4, the same effect can be achieved. This structure can be applied not only to the switchback path 61 but also to other conveyance path paths including the ejection path 62.

Although embodiments according to the present disclosure have been described so far, embodiments of the present disclosure are not limited to the above embodiments, and the components can be modified in practice without departing from the scope of the disclosure. The components disclosed in the above embodiments can also be appropriately combined, to form various embodiments. For example, some components may be omitted from the components described in the above embodiments. Further, components of different embodiments may be appropriately combined.

In this application, the liquid to be discharged should have such a viscosity and a surface tension that the liquid can be discharged from the head, and is not limited to any particular liquid. However, the liquid preferably has a viscosity of 30 mPa·s or lower at ordinary temperature and ordinary pressure, or through heating or cooling. More specifically, the liquid is a solution, a suspension, an emulsion, or the like containing a solvent such as water or an organic solvent, a colorant such as a dye or a pigment, a functionalizing material such as a polymerizable compound, a resin, or a surfactant, a biocompatible material such as deoxyribonucleic acid (DNA), amino acid, protein, or calcium, an edible material such as a natural pigment, and the like. These materials can be used as an inkjet ink, a surface treatment liquid, a liquid for forming components such as electronic elements or light emitting elements or for forming an electronic circuit resist pattern, a three-dimensional modeling material liquid, and the like.

The energy generating source that discharges the liquid may be an energy generating source that uses a piezoelectric actuator (stacked piezoelectric elements and thin-film piezoelectric elements), a thermal actuator using an electrothermal transducer such as a heating resistor, an electrostatic actuator formed with a diaphragm and a counter electrode, or the like.

The "liquid discharge apparatus" may be an apparatus that includes a liquid discharge head or a liquid discharge unit, and drives the liquid discharge head to discharge the liquid. The liquid discharge apparatus is not only an apparatus capable of discharging liquid onto an object to which liquid can adhere, but also an apparatus that discharges liquid into air or liquid.

The "liquid discharge apparatus" may include a preprocessing device, a post-processing device, and the like, as well as the means related to feeding, conveying, and ejecting an object to which liquid can adhere.

For example, the "liquid discharge apparatus" may be an image forming apparatus that forms an image on a paper sheet by discharging ink onto the paper sheet, or a stereoscopic modeling apparatus (a three-dimensional modeling apparatus) that discharges a modeling liquid onto a powder layer in which powder is turned into a layer, to form a stereoscopic modeling object (a three-dimensional modeling object).

Further, the "liquid discharge apparatus" is not necessarily an apparatus that visualizes an image of characters, figures, or the like having meanings with a discharged liquid. For example, the "liquid discharge apparatus" may be an apparatus that forms a pattern or the like that has no meanings, or may be an apparatus that forms a three-dimensional image.

The above "object (medium) to which liquid can adhere" means an object to which liquid can at least temporarily adhere, and the liquid may fix to the object after adhering to the object, or may penetrate into the object after adhering to the object, for example. Specific examples of such objects include media on which recording is to be performed, such as paper sheets, recording paper, recording paper sheets, film, and cloth, electronic components such as electronic substrates and piezoelectric elements, organ models, and media such as test cells. The examples include all objects to which liquid can adhere, unless otherwise specified.

The material of the above "object to which liquid can adhere" may be any material such as paper, thread, fiber, cloth, leather, metal, plastic, glass, wood, or ceramics, as long as liquid can at least temporarily adhere to the object.

Alternatively, the "liquid discharge apparatus" may be an apparatus in which the liquid discharge head and the object to which liquid can adhere move relative to each other, but is not necessarily such an apparatus. Specific examples of such apparatuses include a serial-type apparatus that moves the liquid discharge head, and a line-type apparatus that does not the liquid discharge head.

Further, the "liquid discharge apparatus" may be a treatment liquid applying apparatus that discharges a treatment liquid onto a paper sheet, to apply the treatment liquid to the surface of the paper sheet and modify the surface of the paper sheet, an injection granulating apparatus that granulates fine particles of a raw material by spraying, through a nozzle a composite liquid in which the raw material is dispersed in a solution, or the like.

Note that terms such as image formation, recording, printing, copying, and molding are all synonymous in this application.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid discharge apparatus comprising:

a conveyance path in which a medium is conveyed;

a liquid discharge head to discharge liquid onto the medium conveyed in the conveyance path;

an ejection tray to which the medium is ejected; and a drying device to dry the medium, wherein the conveyance path includes a first bending portion to bend the medium, with a liquid-applied surface of the medium facing inward, the ejection tray includes a second bending portion to bend the medium, with the liquid-applied surface of the medium facing inward, a curvature of the medium bent by the first bending portion is greater than a curvature of the medium bent by the second bending portion, and the drying device dries the medium conveyed in the first bending portion.

2. The liquid discharge apparatus according to claim 1, wherein the liquid contains at least 50% by mass of moisture.

3. The liquid discharge apparatus according to claim 1, wherein the first bending portion bends the medium about a first axis intersecting with a conveyance direction of the medium, and the second bending portion bends the medium about a second axis intersecting with the first axis.

4. The liquid discharge apparatus according to claim 1, wherein the first bending portion includes a switchback path to reverse a conveyance direction of the medium.

5. A liquid discharge apparatus comprising:

a conveyance path in which a medium is conveyed;

a liquid discharge head to discharge liquid onto the medium conveyed in the conveyance path;

an ejection tray to which the medium is ejected; and a drying device to dry the medium, wherein the conveyance path includes a first bending portion to convey the medium between a start point and an end point while bending the medium, with a liquid-applied surface of the medium facing inward, the ejection tray includes a second bending portion to bend the medium, with the liquid-applied surface of the medium facing inward, the second bending portion being raised from a surface of the ejection tray, $(a1/b1)>(a2/b2)$ is satisfied, where a1 represents a distance from a line segment connecting the start point and the end point to a portion of the first bending portion farthest from the line segment, the distance being in a direction perpendicular to the line segment, b1 represents a distance between the start point and the end point of the first bending portion, a2 represents a distance from the surface of the ejection tray to a top end portion of the second bending portion in a direction in which the second bending portion is raised, and b2 represents a distance from one end to the other end of the medium in a sheet width direction of the medium in the second bending portion, and the drying device dries the medium being conveyed in the first bending portion.

6. The liquid discharge apparatus according to claim 5, wherein the second bending portion is movable in the direction in which the second bending portion is raised, and moves in a direction in which a2 becomes smaller with time.

7. The liquid discharge apparatus according to claim 5, wherein $(a0/b0)>(a1/b1)>(a2/b2)$ is satisfied, where a0 and b0 represent a start point and an end point of the switchback path, respectively, the switchback path reversing the conveyance direction of the medium.

8. The liquid discharge apparatus according to claim 5, wherein the liquid contains at least 50% by mass of moisture.

9. The liquid discharge apparatus according to claim 5, wherein the first bending portion bends the medium about a first axis intersecting with a conveyance direction of the medium, and the second bending portion bends the medium about a second axis intersecting with the first axis.

10. The liquid discharge apparatus according to claim 5, wherein the first bending portion includes a switchback path to reverse a conveyance direction of the medium.

* * * * *